US006594896B2

(12) United States Patent
Morihira et al.

(10) Patent No.: US 6,594,896 B2
(45) Date of Patent: Jul. 22, 2003

(54) METHOD FOR MAKING CORRUGATED FINS

(75) Inventors: Shinichi Morihira, Kariya (JP); Kiyokazu Futami, Oobu (JP); Yuuji Sako, Aichi-pref (JP); Keiichi Yoshii, Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/094,754

(22) Filed: Mar. 11, 2002

(65) Prior Publication Data

US 2002/0124404 A1 Sep. 12, 2002

(30) Foreign Application Priority Data

Mar. 12, 2001 (JP) ..... 2001-069187

(51) Int. Cl.[7] ..... B23P 15/00
(52) U.S. Cl. ..... 29/890.03; 29/557
(58) Field of Search ..... 29/890.03, 557, 29/890.046; 72/129, 130, 131, 186, 187, 325, 341

(56) References Cited

U.S. PATENT DOCUMENTS 3,633,398 A * 1/1972 Koch ..... 72/131
4,214,925 A * 7/1980 Arita et al. ..... 148/528
4,626,295 A * 12/1986 Sasaki et al. ..... 148/528
4,736,610 A * 4/1988 Carroll et al. ..... 72/325
4,888,972 A * 12/1989 Rouse ..... 72/186
6,165,291 A * 12/2000 Jin et al. ..... 148/551

FOREIGN PATENT DOCUMENTS

JP 58-1060 1/1983
JP 63-105929 5/1988
JP 410306997 A * 11/1998

* cited by examiner

*Primary Examiner*—I Cuda Rosenbaum
(74) *Attorney, Agent, or Firm*—Harness, Dickey & Pierce, PLC

(57) ABSTRACT

Residual stress generated in strip metal W is removed by annealing the strip metal W which has gone through a pressing process, and a compressing process is implemented thereafter whereby, as portions hardened due to work-hardening (in particular, folded portions 121) can be softened, the strip metal W which has gone through the pressing process can be easily compressed so that the radius of curvature of the folded portions 121 is reduced to a predetermined dimension, thereby making it possible to improve the dimensional accuracy of the finished fin 120 even if the fin 120 is made of a metal having a relatively high hardness (stainless steel).

3 Claims, 4 Drawing Sheets

METHOD FOR MAKING CORRUGATED FINS

BACKGROUND OF THE INVENTION

1. Field of the Invention

The present invention relates to a method for making corrugated fins (hereinafter, simply referred to as fins), for heat exchangers, which each have louvers formed therein.

Note that louvers are formed by cutting part of a fin to let the portions so cut rise in a shutter-like fashion with a view to diverting the direction of fluid flowing around the fin to control the development of a temperature boundary layer.

2. Description of the Related Art

In a common fin making method, strip metal (work) is subjected to press working such as roll forming (refer to JIS (Japanese Industry Standard) B 0122) to be formed into a corrugated configuration while part of the strip metal is being cut and raised into louvers, then the corrugated strip metal is compressed so that the radius of curvature of folded portions (crests and roots) is reduced, and thereafter the strip metal is cut so that each part of the strip metal so cut has a predetermined number of crests (roots).

Incidentally, when strip member comprising a ¼ H (Hard: Quality discrimination) material or 0(Soft: Quality discrimination) material (refer to JIS (Japanese Industry Standard) H 0500) which is made of a metal such as brass having a relatively low hardness is subjected to press working in order to form the strip member into a corrugated configuration while part of the strip member is being cut and raised into louvers, since the material of the strip member is soft and is easy to elongate, a mold (a cutter) for cutting and raising part of the material into louvers has difficulty in being removed from the strip metal, and as a result, a forming failure is likely to happen easily so that portions of the strip member, where louvers 123 are formed, tend to curve as shown in FIG. 9 or that cracks are generated.

To cope with this, the strip member used to form fins is usually made of a metal having a relatively high hardness such as a ½ H (Hard) material or H (Hard) material which has a hardness higher than that of the ¼ H (Hard) material or 0(Soft) material.

However, when such strip metal having a relatively high hardness is subjected to press working, the force opposing plastic working is increased by work-hardening generated at folded portions (crests and roots) and, therefore, even if the fin is plastically deformed to compress the corrugated strip metal, the radius of curvature of the folded portions (crests and roots) cannot be reduced to a predetermined dimension, this causing a problem that the dimensional accuracy of the fin so formed becomes low.

SUMMARY OF THE INVENTION

The invention was made in view of the above problem and the object thereof is to improve the dimensional accuracy of a finished fin which is made of a metal having a relatively high hardness.

With a view to attaining the object, according to the invention, there is provided a method for making corrugated fins for heat exchangers which are formed into a corrugated configuration having a plurality of folded portions (121) and which each have louvers (123) formed in flat flank portions (122) connecting adjacent folded portions (121) by cutting part of the flank portions to let the cut portions rise in a shutter-like fashion, the method comprising a pressing process in which strip metal (W) is subjected to press working so that the strip metal is formed into a corrugated configuration while louvers (123) are being cut and raised in part of the strip metal, a heat treatment process in which residual stress generated in the strip metal (W) is removed after the completion of the pressing process and a compressing process in which the corrugated strip metal (W) is compressed so as to reduce the radius of curvature of the folded portions (121) after the completion of the heat treatment process.

According to the fin forming method, as the residual stress generated in the strip metal (W) is removed by subjecting the strip metal (W), which has gone through the pressing process, to heat treatment, the portions (in particular, the folded portions (123)), which are hardened due to work-hardening, can be softened.

Consequently, as the strip metal (W) which has gone through the pressing process can be easily compressed so that the radius of curvature of the folded portions (121) is reduced to a predetermined dimension, the dimensional accuracy of the finished corrugated fin can be improved even if the fin is made of a metal having a relatively high hardness.

According to the invention, there are also provided a method for making corrugated fins for heat exchangers in which a metal of an iron group is used as strip metal, and corrugated fins are made of the strip metal through processes identical to those of the above fin making method, as well as a method for making corrugated fins for heat exchangers in which a metal of a stainless steel group is used as strip metal, and corrugated fins are made of the strip metal through processes identical to those of the above fin making method, and the same effectiveness provided by the first method can also be provided by the latter two methods.

The present invention will be more fully understood from the description of preferred embodiments of the invention, as set forth below, together with the accompanying drawings.

DESCRIPTION OF THE PREFERRED EMBODIMENTS

Figure 1:
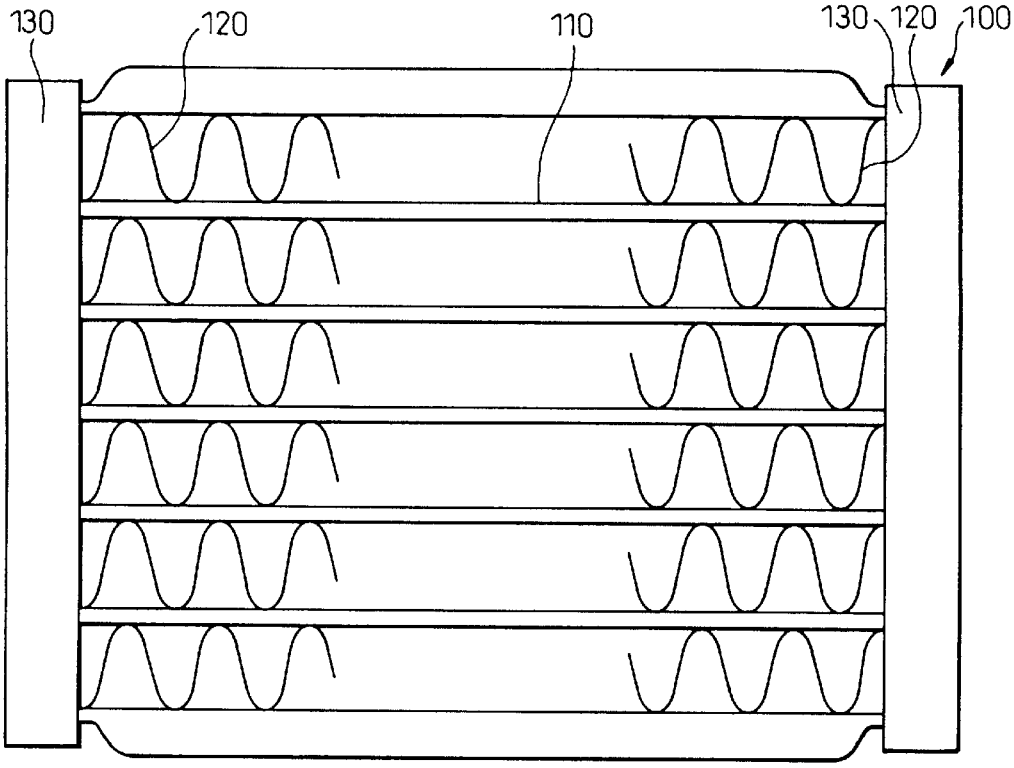
FIG. 1 is an exemplary diagram showing a heat exchanger having corrugated fins made by using a method for making corrugated fins for heat exchangers according to an embodiment of the invention.

FIG. 1 is an exemplary diagram showing a heat exchanger 100 having corrugated fins made using a method for making corrugated fins for heat exchangers according to an embodiment of the invention, in which reference numeral 110 denotes a tube made of a stainless steel through which water (fluid) flows, and reference numeral 120 denotes a corrugated fin adapted to promote heat exchange between water flowing through the tubes 110 and air.

Reference numeral 130 denotes a header tank disposed at longitudinal ends of a plurality of tubes 110 in such a manner as to communicate with each of the plurality of tubes 110. The header tank 130 disposed on the right-hand side of the drawing is designed to distribute water to the respective tubes 110 whereas the header tank 130 on the left-hand side of the drawing is designed to collect the water which has been used for heat exchange.

Figure 2:
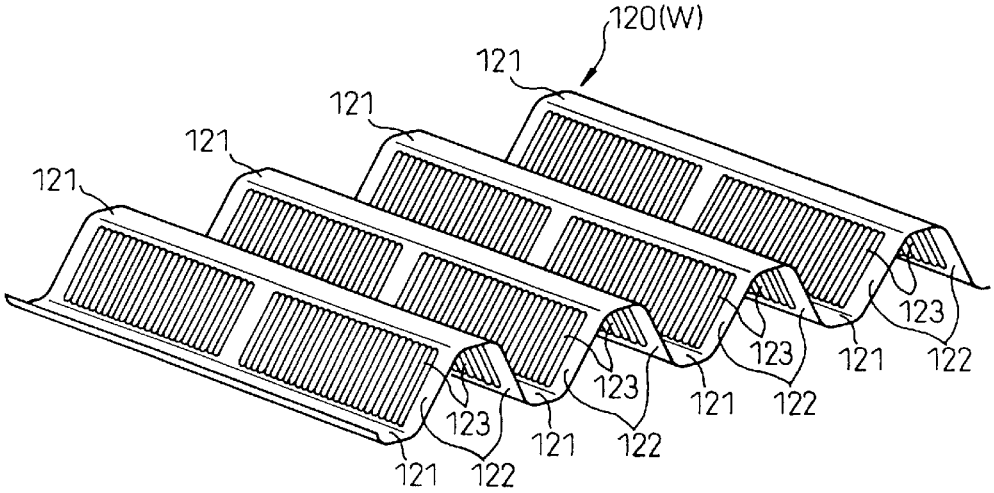
FIG. 2 is a perspective view of the corrugated fin according to the embodiment of the invention.

Incidentally, as shown in FIG. 2, the corrugated fin 120 has a plurality of folded portions (crests and roots) 121 and is formed into a corrugated configuration while louvers are being cut and raised into a shutter-like fashion in flat flank portions 122 connecting adjacent folded portions 121. In this embodiment, the corrugated fin 120 is made of a strip metal W of stainless steel (SUS304) having a thickness of 50 $\mu$m.

Next, a method for making the corrugated fin 120 (hereinafter, simply referred to as fin 120) will be described, step by step, in the order in which the steps occur.

Strip metal W of a metal of stainless steel system is subjected to press working so that the strip metal W is formed into a corrugated configuration while louvers 123 are being cut and raised in the strip metal W (a pressing process), and the strip metal W, which has been formed into the corrugated configuration at the pressing process, is then cut in such a manner that each strip metal has a predetermined number of crests (roots) (a cutting process).

Next, the strip metal W cut at the cutting process so as to have the predetermined number of crests is annealed so as to remove residual stress generated the strip metal W (in particular, at the folded portions 121) (a heat treatment process). Note that, in this embodiment, the strip metal W, which has gone through the pressing process, is annealed by heating it at 1050 degrees centigrade for 30 minutes and forcibly cooling the strip metal so heated in an atmosphere of an inactive gas (nitrogen in this embodiment) by operating a fan.

Thereafter, the corrugated strip metal W is compressed so that the radius of curvature of the folded portions 121 is reduced to a predetermined dimension (a compressing process) and the strip metal W is then subjected to external inspection and dimension inspection.

Figure 3:
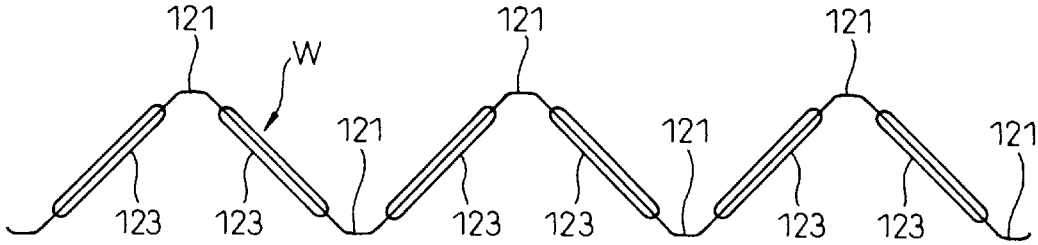
FIG. 3 is an exemplary diagram of a strip metal resulting at a point in time when a cutting process (a pressing process) is completed.
Figure 4:
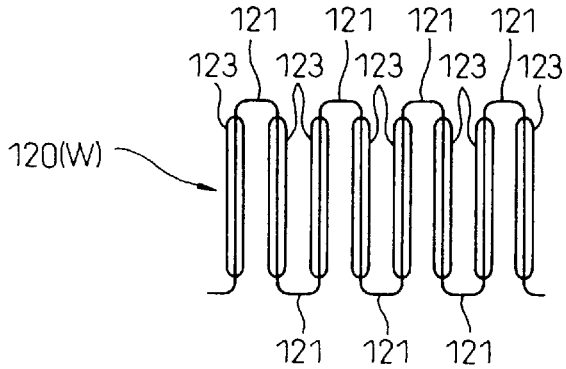
FIG. 4 is a diagram showing the strip metal (a completed fin) resulting at a point in time when a compressing process is completed.
Figure 5:
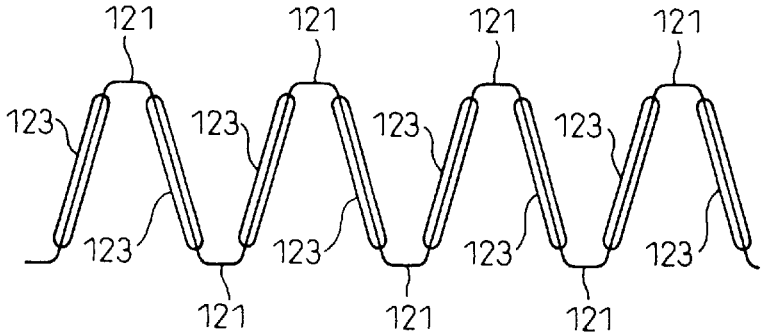
FIG. 5 is a diagram showing a strip metal (a completed fin) resulting when the compressing process is implemented without annealing (heat treatment) (a method for making corrugated fins according to the prior art)

Incidentally, FIG. 3 is an exemplary diagram showing the strip metal W at a point in time when the cutting process (the pressing process) is completed, FIG. 4 is the strip metal W (a completed fin) at a point in time when the compressing process is completed, and FIG. 5 is a diagram showing the strip metal W (a completed fin) which is subjected to the compressing process without annealing (a heat treatment) (a method for making corrugated fins according to the prior art).

Figure 6:
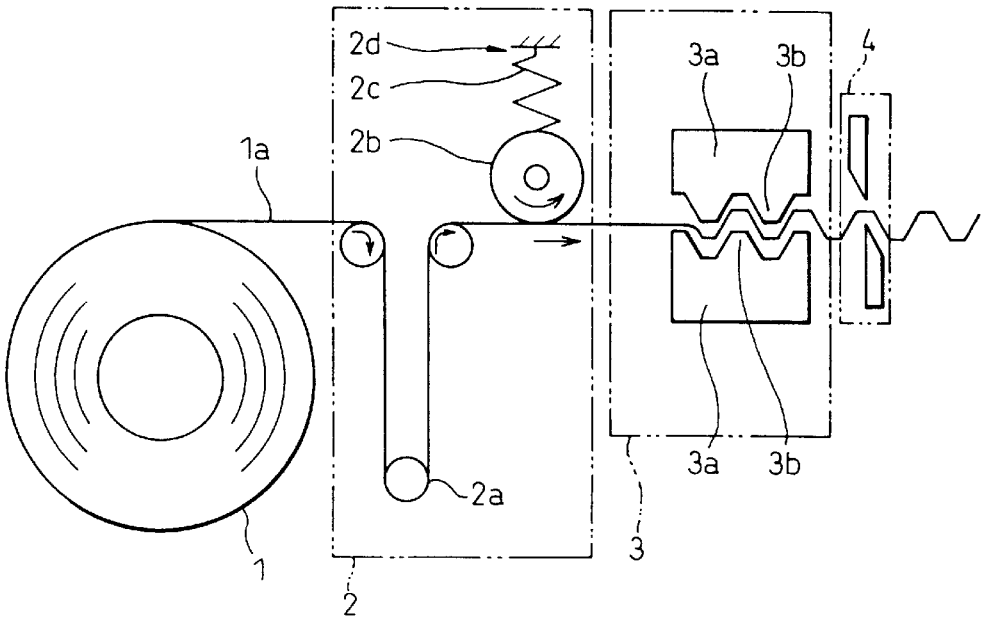
FIG. 6 is an exemplary diagram showing a press device for implementing the pressing process and the cutting process.
Figure 7:
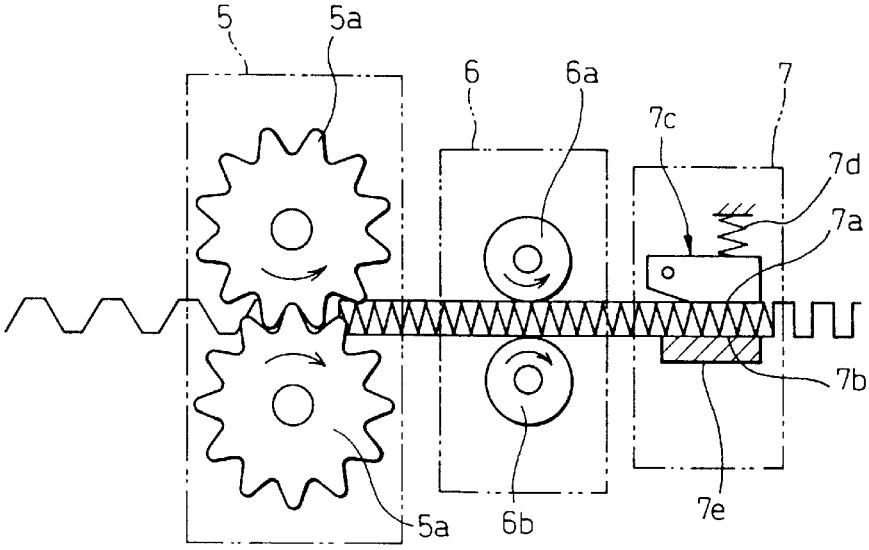
FIG. 7 is an exemplary diagram showing a device for implementing the compressing process.

FIG. 6 shows a press for use in implementing the pressing process and the cutting process, FIG. 7 is an exemplary diagram showing a device for use in implementing the compressing process. In FIG. 6, reference numeral 1 denotes a material roll (an uncoiler) around which a thin strip metal W is wound, and a predetermined tension is imparted to a fin material fed from this material roll by means of a tension device 2 for imparting the predetermined magnitude of tension to the strip metal W. This tension device 2 is constituted by a weight tension portion 2*a* for imparting a certain tension to the strip metal W through a gravitational force and a rotation portion 2*d* comprising a roller 2*b* adapted to turn as the strip metal W travels and a spring means 2*c* for imparting the predetermined tension to the strip metal W via the roller 2*b*.

Note that imparting the predetermined tension to the strip metal W by the tension device 2 is to maintain constant the height of the corrugated fin formed by being folded by a fin forming device 3 (the difference in height between adjacent folded portions 121).

Reference numeral 3 denotes the fin forming device for vertically pressing the strip metal W to which the predetermined tension is imparted by the tension device 2 not only to form a multiplicity of folded portions 121 thereon to form the strip metal W into a corrugated configuration but also to form louvers 123 in portions corresponding to flat flank portions 122.

This fin forming device is constituted by a pair of dies 3*a* for pressing and cutters (not shown) formed in toothed surfaces of the dies 3*a* for forming louvers 123, and the strip metal W is folded in such a manner as to follow toothed portions 3*b* of the dies 3*a* while the strip metal W passes through the dies 3*a*, whereby folded portions 121 and louvers 123 are formed substantially simultaneously.

Reference numeral 4 denotes a cutting device for cutting the strip metal W in which folded portions 121 and louvers 123 are formed, and this cutting device 4 is designed to cut the strip metal W to a predetermined length in such a manner that each fin 120 has a predetermined number of folded portions 121.

In addition, in FIG. 7, reference numeral 5 denotes a device 5 for feeding the strip metal W which has gone through annealing (a heat treatment process) toward a leveling device 6, and this feeding device 5 is constituted by a pair of gear-like feeding rollers 5*a* having a reference pitch substantially equal to a distance between folded portions 121 formed by the fin forming device 3.

Reference numeral 6 denotes the leveling device for pressing folded portions 121 from a direction which is substantially normal to a ridge direction of the folded portion 121 to level the irregularities of the folded portions 121, and this leveling device 6 is constituted by a pair of leveling rollers 6*a*, 6*b* adapted to hold therebetween the strip metal W and to turn in a following fashion as the strip metal W travels between the rollers. Note that the leveling rollers 6*a*, 6*b* are disposed such that a line connecting the rotating centers of the leveling rollers 6*a*, 6*b* intersects at right angles the traveling direction of the strip metal W.

Reference numeral 7 denotes a brake device having brake surfaces 7*a*, 7*b* for generating a frictional force in a direction opposite to the traveling direction of the strip metal W when they contact the plurality of folded portions 121. This brake device 7 is disposed farther than the leveling device 6 in the traveling direction of the strip metal W so that the strip metal W is pressingly compressed, by virtue of a feeding force generated by the feeding device 5 and a frictional force generated by the brake surfaces 7*a*, 7*b*, in such a manner that the folded portions 121 of the strip metal W contact each other.

In addition, a brake shoe 7*c*, on which the brake surface 7*a* is formed, is rotatably supported at one end thereof, and a spring member 7*d* is disposed at the other end thereof which constitutes a frictional force adjusting mechanism. Then, the frictional force generated by the brake surfaces 7*a*, 7*b* is adjusted by adjusting the deflection of this spring member 7*d*. In addition, a plate portion 7*e* constituting the brake shoe 7*c* and the brake surface 7*b* is formed from a material having superior abrasion resistance and, in this embodiment, a die steel is used.

Next, the characteristics (the function and effectiveness) of the embodiment of the invention will be described.

In this embodiment, as the residual stress generated in the strip metal W is removed by annealing the strip metal W which has gone through the pressing process, the hardened portions due to work-hardening (in particular, the folded portions 121) are softened.

Consequently, as the strip metal W which has gone through the pressing process can easily be compressed so that the radius of curvature of the folded portions 121 can be reduced to the predetermined dimension, the dimensional accuracy of a completed fin 120 can be improved even if the fin 120 is made of a metal (in this embodiment, a stainless steel) having a relatively high hardness.

Figure 8:
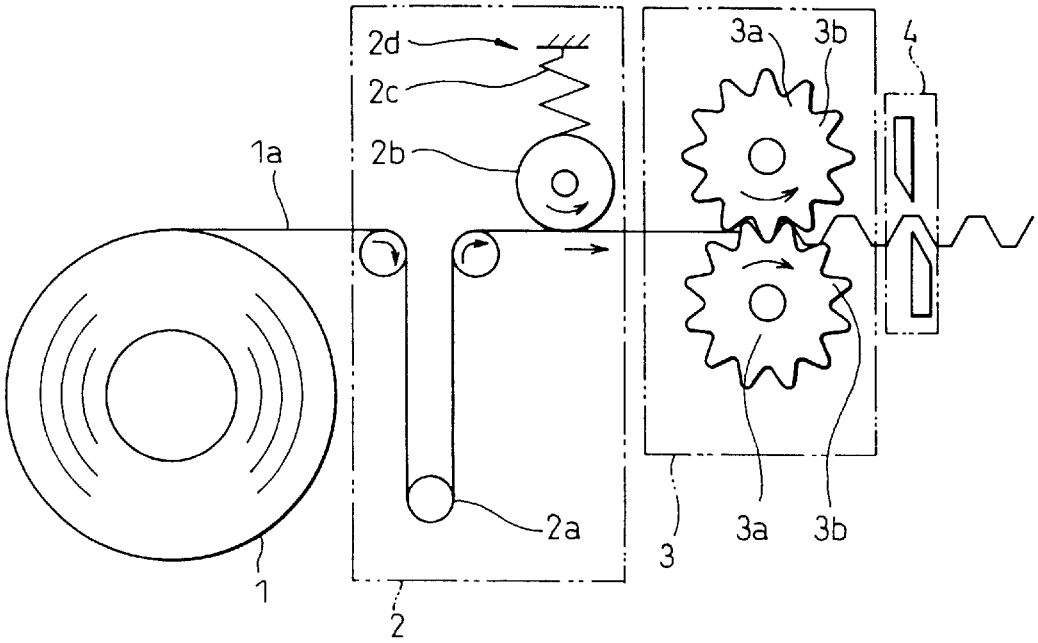
FIG. 8 is an exemplary diagram showing a modified example of the press device for implementing the pressing process and the cutting process.
Figure 9:
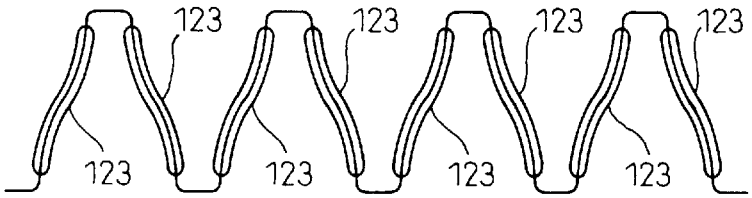
Fig.9 PRIOR ART
FIG. 9 is a diagram showing a strip metal (a completed fin) resulting when a method for making corrugated fins according to the prior art is used.

In the aforesaid embodiment, while pressing is implemented vertically in the pressing process, pressing may be implemented as roll forming by forming rollers 3*a* as shown in FIG. 8.

In addition, the application of the corrugated fin made using the corrugated fin making method according to the invention is not limited to the heat exchanger illustrated in the embodiment but the corrugated fin so made may be applied to a heat exchanger for use in a high-temperature and corrosive environment existing in a fuel cell system or a micro gas turbine system.

Furthermore, in the above embodiment, while a corrugated fin is used which is formed into a rectangular corrugation, the invention is not limited to the corrugated fin of such a configuration but may be used in forming a corrugated fin of a sine-wave configuration.

Moreover, in the aforesaid embodiment, while the cutting process is performed after the completion of the pressing process, the invention is not limited to that sequence, and the cutting process may be implemented after the completion of the compressing process.

In addition, in the above embodiment, while the strip metal W made of the metal of a stainless steel group is used, the corrugated fin making method according to the invention can provide the same function and effectiveness even if strip metal made of a normal metal or a metal of an iron group is used.

While the invention has been described by reference to specific embodiments chosen for purposes of illustration, it should be apparent that numerous modifications could be made thereto by those skilled in the art without departing from the basic concept and scope of the invention.

What is claimed:

1. A method for making corrugated fins for heat exchangers which are formed into a corrugated configuration having a plurality of folded portions and which each have louvers formed in flat flank portions connecting adjacent folded portions by cutting part of said flank portions to let the portions so cut rise in a shutter-like fashion, said method comprising a pressing process in which strip metal is subjected to press working so that said strip metal is formed into a corrugated configuration while louvers are being cut and raised in part of said strip metal, a heat treatment process in which residual stress generated in said strip metal is removed after the completion of said pressing process and a compressing process in which said corrugated strip metal is compressed so as to reduce the radius of curvature of said folded portions after the completion of said heat treatment process.

2. A method for making corrugated fins as set forth in claim 1, wherein a metal of an iron group is used as said strip metal.

3. A method for making corrugated fins as set forth in claim 1, wherein a metal of a stainless group system is used as said strip metal.

* * * * *